US007096113B2

(12) United States Patent
Ludwig et al.

(10) Patent No.: US 7,096,113 B2
(45) Date of Patent: Aug. 22, 2006

(54) METHOD FOR CONTROLLING A REGENERATION VALVE OF A FUEL VAPOR RETENTION SYSTEM

(75) Inventors: Wolfgang Ludwig, Butzbach-Maibach (DE); Matthias Wiese, Frankfurt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/535,037

(22) PCT Filed: Oct. 1, 2003

(86) PCT No.: PCT/DE03/03272

§ 371 (c)(1),
(2), (4) Date: May 12, 2005

(87) PCT Pub. No.: WO2004/044413

PCT Pub. Date: May 27, 2004

(65) Prior Publication Data

US 2006/0054143 A1 Mar. 16, 2006

(30) Foreign Application Priority Data

Nov. 13, 2002 (DE) ..... 102 52 826

(51) Int. Cl.
*F02M 25/08* (2006.01)
*F02D 31/00* (2006.01)
*F02P 5/15* (2006.01)
*F02M 33/00* (2006.01)

(52) U.S. Cl. ..... 701/114; 701/103; 701/115; 123/520

(58) Field of Classification Search ..... 701/101, 701/102, 103, 114, 115; 123/339.14, 339.15, 123/674, 698, 518, 519, 520, 399, 568.16, 123/568.21, 568.22; 318/254, 439, 599; 251/129.04, 129.05
See application file for complete search history.

(56) References Cited

U.S. PATENT DOCUMENTS

| | | | | |
|---|---|---|---|---|
| 4,378,777 | A * | 4/1983 | Iida et al. | 123/568.16 |
| 4,433,666 | A * | 2/1984 | Masaki et al. | 123/568.22 |
| 5,216,991 | A | 6/1993 | Iida et al. | |
| 5,299,544 | A | 4/1994 | Kitamoto et al. | |
| 5,351,193 | A * | 9/1994 | Poirier et al. | 123/520 |
| 5,623,914 | A * | 4/1997 | Kawamoto et al. | 123/520 |
| 5,690,086 | A * | 11/1997 | Kawano et al. | 123/674 |
| 5,850,820 | A | 12/1998 | Tsutsumi et al. | |
| 5,873,350 | A * | 2/1999 | Wild et al. | 123/520 |
| 6,378,515 | B1 * | 4/2002 | Geyer | 123/698 |
| 6,465,974 | B1 * | 10/2002 | Watanabe | 318/254 |
| 6,484,693 | B1 * | 11/2002 | Kanno | 701/114 |
| 6,651,640 | B1 * | 11/2003 | Sealy et al. | 123/698 |

FOREIGN PATENT DOCUMENTS

| | | | | |
|---|---|---|---|---|
| DE | 196 10 169 A1 | | 9/1997 | |
| JP | 2001193496 A | * | 7/2001 | 318/254 |

* cited by examiner

*Primary Examiner*—Willis R. Wolfe, Jr.

(57) ABSTRACT

The invention relates to an operating method for a regeneration valve of a fuel vapor retention system, particularly of a tank vent valve for regenerating an activated carbon filter during which the regeneration valve is controlled by a control signal, whereby the control signal corresponds to a designated valve position of the regeneration valve. The invention provides that the correlation between the control signal and the resulting valve position of the regeneration valve is determined during a calibration process.

9 Claims, 5 Drawing Sheets

METHOD FOR CONTROLLING A REGENERATION VALVE OF A FUEL VAPOR RETENTION SYSTEM

CROSS REFERENCE TO RELATED APPLICATION

This application is the US National Stage of International Application No. PCT/DE2003/003272, filed Oct. 1, 2003 and claims the benefit thereof. The International Application claims the benefits of German Patent application No. 10252826.8 DE filed Nov. 13, 2002, both of the applications are incorporated by reference herein in their entirety.

1. Field of the Invention

The invention relates to a method for controlling a regeneration valve according to the preamble of the claims.

2. Background of the Invention

Modern motor vehicles with spark ignition engines have a fuel tank in which the fuel vapors which are emitted while standing still are collected by an activated carbon filter in order to prevent damage to the environment. However, such activated carbon filters only have a limited capacity and must therefore be regenerated while operating in order to subsequently again be able to absorb fuel vapors. This regeneration of an activated carbon filter takes place by flushing with fresh air in which case the fuel vapors collected in the activated carbon filter are released. For this purpose, the activated carbon filter is connected to the intake pipe of the spark ignition engine via a controllable tank vent valve in such a way that the spark ignition engine takes in fresh air through the activated carbon filter in the case of an open tank vent valve and as a result regenerates the activated carbon filter.

While an activated carbon filter is being regenerated, the fuel vapors flushed from the activated carbon filter get into the intake pipe of the spark ignition engine and as a result change the ratio of the mixture and the filling ratio causing an increase in the engine torque.

While such spark ignition engines are being operated, this disturbing influence of regenerating an activated carbon filter can be compensated for by regulating it, for example, by changing the throttle valve position accordingly or adjusting the ignition angle.

However, if such a spark ignition engine is operated dynamically, it is often not possible to carry out such a regulation with a view to compensating for the disturbing influence so that as a result a correction via a suitable control system takes place. In this case the control system is based on a physical model which requires knowledge of the valve characteristic of the tank vent valve. The correlation between the pulse-width modulated control signal for the tank vent valve and the corresponding valve position of the tank vent valve is therefore determined by the manufacturer in the case of the known control systems and stored in a performance graph in such a way that the control system can fall back on the stored correlation between the control signal and the associated valve position while operating in order to compensate for the disturbing influence of regenerating an activated carbon filter by means of a suitable control system.

A disadvantage of this known method is the fact that the correlation between the pulse-width modulated control signal for the tank vent valve and the resulting valve position can be subject to fluctuations in which case the fluctuations are based on manufacturing tolerances, contamination and ageing effects as well as on temperature influences. As a result, the conventional control system with a view to compensating for the disturbing influence of regenerating an activated carbon filter therefore functions unsatisfactorily.

The publication U.S. Pat. No. 5,216,991 discloses a method for controlling a regeneration valve of a fuel vapor retention system for an internal combustion engine in the case of which the regeneration valve is controlled with a control signal, whereby the control signal corresponds to a designated valve position of the regeneration valve and the correlation between the control signal and the resulting valve position of the regeneration valve is determined during a calibration process.

SUMMARY OF THE INVENTION

Therefore, it is the object of the invention to create a method for controlling a tank vent valve which makes possible a better compensation for the disturbing influence of regenerating an activated carbon filter.

Taking a known method for controlling a tank vent valve as the starting point, this object of the invention is achieved according to the preamble of the claims by the characterizing features of the claims.

The invention includes the general technical teaching that the correlation between the control signal for the tank vent valve and the resulting valve position while operating is determined within the framework of a calibration process. Thus, the regeneration valve is controlled sequentially with different values of the control signal. The speed and/or the air ratio of the internal combustion engine is regulated to predetermined desired values in the case of each value of the control signal and the engine interventions required for this are determined. The valve position of the regeneration valve is derived from the engine intervention for each value of the control valve. The individual value of the control signal and the resulting valve position are then also stored as support points of a valve characteristic. This offers the advantage that ageing and contamination effects, manufacturing tolerances as well as temperature fluctuations are taken into consideration, which leads to a more accurate determination of the correlation between the control signal and the resulting valve position. When regenerating the activated carbon filter, the disturbing influence of the fuel vapors flushed from the activated carbon filter can then be compensated for in a better way.

The calibration process according to the method of the invention is preferably carried out while the internal combustion engine is idling in which case the disturbing influence of the fuel vapors flushed from the activated carbon filter is preferably already compensated for by the existing regulations.

For example, the idling speed can be measured and regulated at a predetermined desired value by means of engine intervention. The fuel vapors flushed from the activated carbon filter when it is regenerated then first of all increase the engine torque and the resulting speed, in which case this disturbance variable is again controlled by the engine intervention as a result of which the idling speed is stabilized.

However, it is also possible that during calibration, the air ratio of the exhaust gas of the internal combustion engine is measured and regulated to a predetermined desired value. The fuel vapors flushed from the activated carbon filter during regeneration then first of all change the ratio of the mixture in the intake tract of the internal combustion engine, thereby changing the air ratio of the exhaust gas. This changing of the air ratio by regenerating the activated carbon filter is then compensated for by a suitable engine intervention as a result of which the air ratio is stabilized.

The degree of the engine intervention required while the activated carbon filter is being regenerated in order to control the disturbance variable is, in this case, a measure for determining the volume of flushed fuel vapors and therefore allows a conclusion to be drawn about the valve position of the tank vent valve. If, for example, an extensive engine intervention is required in order to control the disturbance variable when the activated carbon filter is regenerated, then this is based on a correspondingly high mass or volume flow from the activated carbon filter which is only possible in the case of a tank vent valve which is open accordingly wide. However, if on the other hand, no or only a slight engine intervention is required to control the disturbance variable while the activated carbon filter is being regenerated, then this as a result means that the tank vent valve is closed or only opened slightly so that only a slight mass or volume flow is extracted or drawn off from the activated carbon filter in the intake tract of the internal combustion engine.

The engine intervention to compensate for the regeneration of the activated carbon filter during calibration can include different measures which can be used alone or in combination with one another.

For example, the throttle valve position can be changed in order to compensate for the fuel vapors flushed from the activated carbon filter during regeneration. In this way, the throttle valve can be closed completely or partially while the activated carbon filter is being regenerated so that the sum total of the mass or volume flow sucked in or drawn in via the throttle valve and the mass or volume flow flushed from the activated carbon filter while the activated carbon filter is being regenerated remains as constant as possible.

In addition, the engine intervention with a view to compensating for the fuel vapors flushed from the activated carbon filter during regeneration also consists of the fact that the ignition angle must be adjusted in order to change the engine torque accordingly. If, for example, the tank vent valve is opened completely, then a relatively large volume of fuel vapor flows into the intake tract of the internal combustion engine as a result of which the filling ratio and therefore the engine torque are increased. The ignition angle can then be retarded in order to reduce the engine torque accordingly.

The invention does not necessarily require a complete determination of the valve characteristic of the tank vent valve. However, it is also possible that only individual support points of the valve characteristic are determined.

Of particular importance in this case is the opening point of the tank vent valve, i.e. the control signal in the case of which the tank vent valve opens. In order to determine this opening point, the engine intervention can be compared to a predetermined limiting value. If the degree of the engine intervention required with a view to compensating for the fuel vapor flushed from the activated carbon filter exceeds the limiting value it can be assumed that the tank vent valve is open. If, on the other hand, the degree of the required engine intervention is below the limiting value then this indicates that the tank vent valve is closed.

If the engine intervention consists of changing the throttle valve position, then the angle of change of the throttle valve position required for the compensation process can be compared to the limiting value in order to determine the opening point of the tank vent valve.

If, on the other hand, the engine intervention includes an adjustment of the ignition angle, then the change of the ignition angle required for the compensation process can be compared to the limiting value in order to determine the opening point of the tank vent valve.

In order to determine the opening point of the tank vent valve, the control signal for the tank vent valve can then be increased progressively until the said comparison of the engine intervention to the predetermined limiting value shows that the tank vent valve has opened. It is then possible to derive the associated valve position from the engine intervention required for this as has already been explained above.

In this way it is also possible to determine, in addition to the opening point, further support points of the valve characteristic. For this purpose, further values of the control signal are set progressively for the tank vent valve while the engine intervention, which is required to compensate for the fuel vapors flushed from the activated carbon filter, is determined in each case. It is then possible to derive the associated valve position from the engine intervention as has already been explained above. In this way, it is then possible to determine several support points of the valve characteristic in which case each support point consists of one value of the control signal for the tank vent valve and the valve position.

The control signal for the tank vent valve is preferably a pulse-width modulated electrical signal in which case the pulse width determines the valve position of the tank vent valve. However, within the framework of the invention it is also possible to use another control signal such as a pulse-amplitude modulated signal instead of a pulse-width modulated signal.

In addition, the invention is not limited to tank vent valves for the spark ignition engines mentioned at the beginning, but can also be used in other internal combustion engines that are operated with volatile fuels.

In addition, the invention is not limited to fuel supply systems with an activated carbon filter for storing the fuel vapors which are emitted. However, it is also possible to use another component instead of an activated carbon filter, said component absorbing the fuel vapors which are emitted from the fuel tank in order to prevent damage to the environment.

Moreover, the invention is not limited to fuel supply systems in which the tank vent valve is arranged between the intake tract of the internal combustion engine and the activated carbon filter. In general, the invention also includes a method for controlling a regeneration valve of a fuel vapor retention system in the case of which the regeneration valve can also be arranged in another place within the fuel supply system.

BRIEF DESCRIPTION OF THE DRAWINGS

Other advantageous further developments of the invention are included in the subclaims or are explained below on the basis of the accompanying drawings. They are as follows:

DETAILED DESCRIPTION OF THE INVENTION

Figure 1:
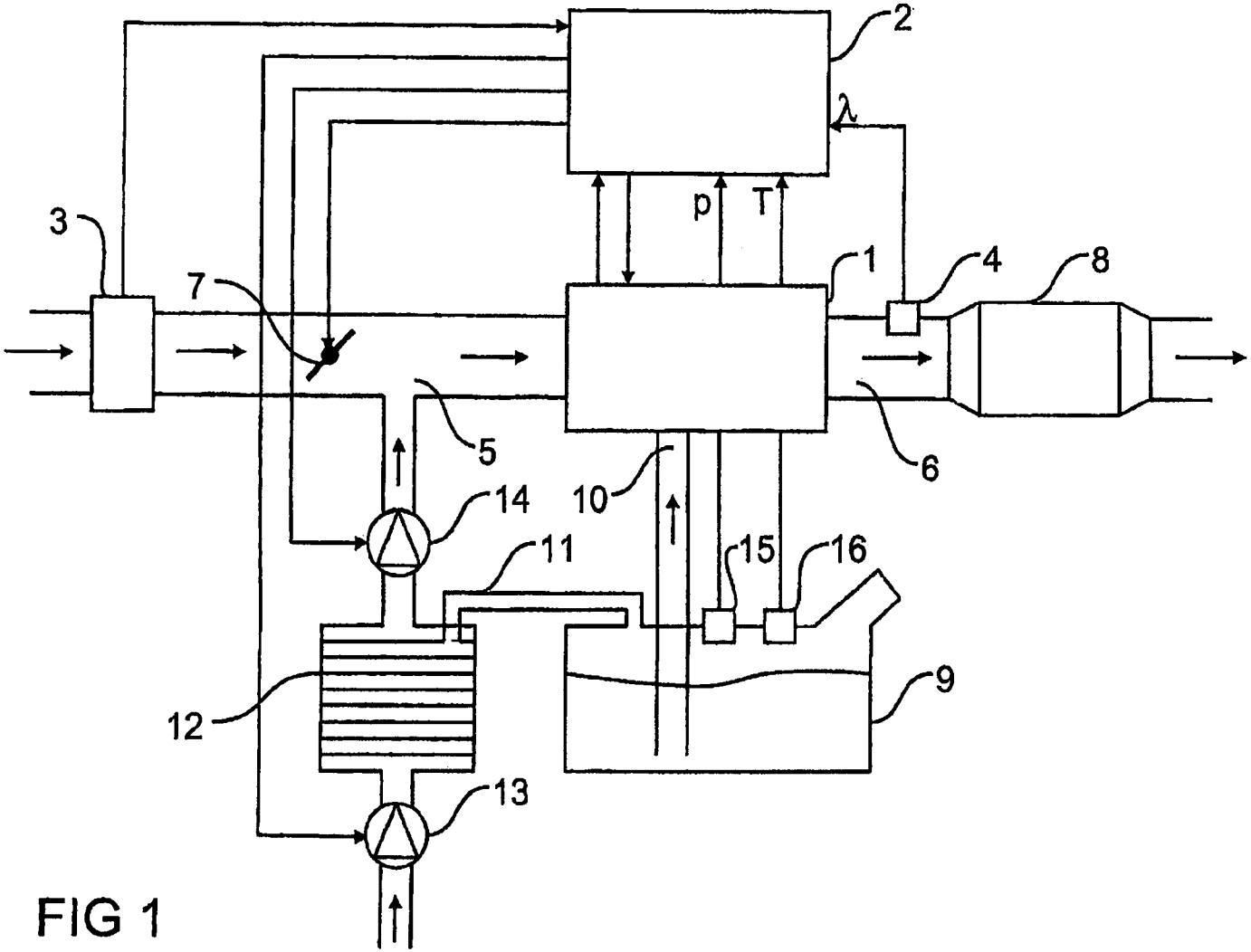
FIG. 1—a fuel supply system of an internal combustion engine with an exhaust gas catalytic converter, FIG. 2*a*–2*c*—the method according to the invention in the form of a flow chart as well as FIG. 3—a characteristic of a vent valve.

The representation in FIG. 1 shows an internal combustion engine 1 with an injection system in which case the internal combustion engine 1 is constructed in a conventional way and is therefore only shown diagrammatically.

The internal combustion engine 1 is controlled by an electronic control unit 2 in which case the control unit 2, for example, specifies the moment of injection as well as the duration of injection of the injection system.

The control unit 2 evaluates the measuring signals of a mass air flow sensor 3 as well as a lambda sensor 4 as input signals, in which case, the mass air flow sensor 3 is arranged in an intake tract 5 of the internal combustion engine 1 while the lambda sensor 4 is located on the outlet side of the internal combustion engine 1 in an exhaust gas duct 6.

In addition, a throttle valve 7 is also arranged in the intake tract 5 of the internal combustion engine 1, said throttle valve controlling the mass air flow sensor sucked in or drawn in by the internal combustion engine 1 and is set by means of the control unit 2.

Moreover, a conventional three-way catalytic converter 8 is arranged in the exhaust gas duct 6.

A fuel tank 9 is provided for the fuel supply which is connected to the internal combustion engine 1 via a fuel line 10 which is only shown diagrammatically.

In addition, the fuel tank 9 has a vent line 11 which opens into an activated carbon filter 12, in which case the activated carbon filter 12 can store intermediately the fuel which is emitted from the fuel tank 9. This prevents fuel which is emitted from escaping from the fuel container 9 which would contaminate the environment.

However, the activated carbon filter 12 only has a limited storage capacity and must therefore occasionally be flushed with ambient air in order to flush the stored fuel from the activated carbon filter 12. Therefore, the activated carbon filter 12 is connected to the environment via a controllable valve 13, in which case the valve 13 is controlled by means of the control unit 2. In addition, the activated carbon filter 12 is connected to the intake tract 5 of the internal combustion engine 1 via a controllable valve 14.

Therefore, when valves 13 and 14 are in the open state, the internal combustion engine 1 sucks in or draws in ambient air via the activated carbon filter 12, in which case the fuel emissions stored in the activated carbon filter 12 are flushed and, as a result, lubricate slightly the mixture in the intake tract 5 of the internal combustion engine 1 which is measured by the lambda probe 4. Therefore, in order to flush the activated carbon filter 12, the two valves 13 and 14 are kept open until the lambda probe 4 no longer measures any lubrication of the mixture in the intake tract 5, because then all the fuel emissions have been flushed from the activated carbon filter 12 and in this way the storage capacity of the activated carbon filter 12 is restored.

Figure 3:
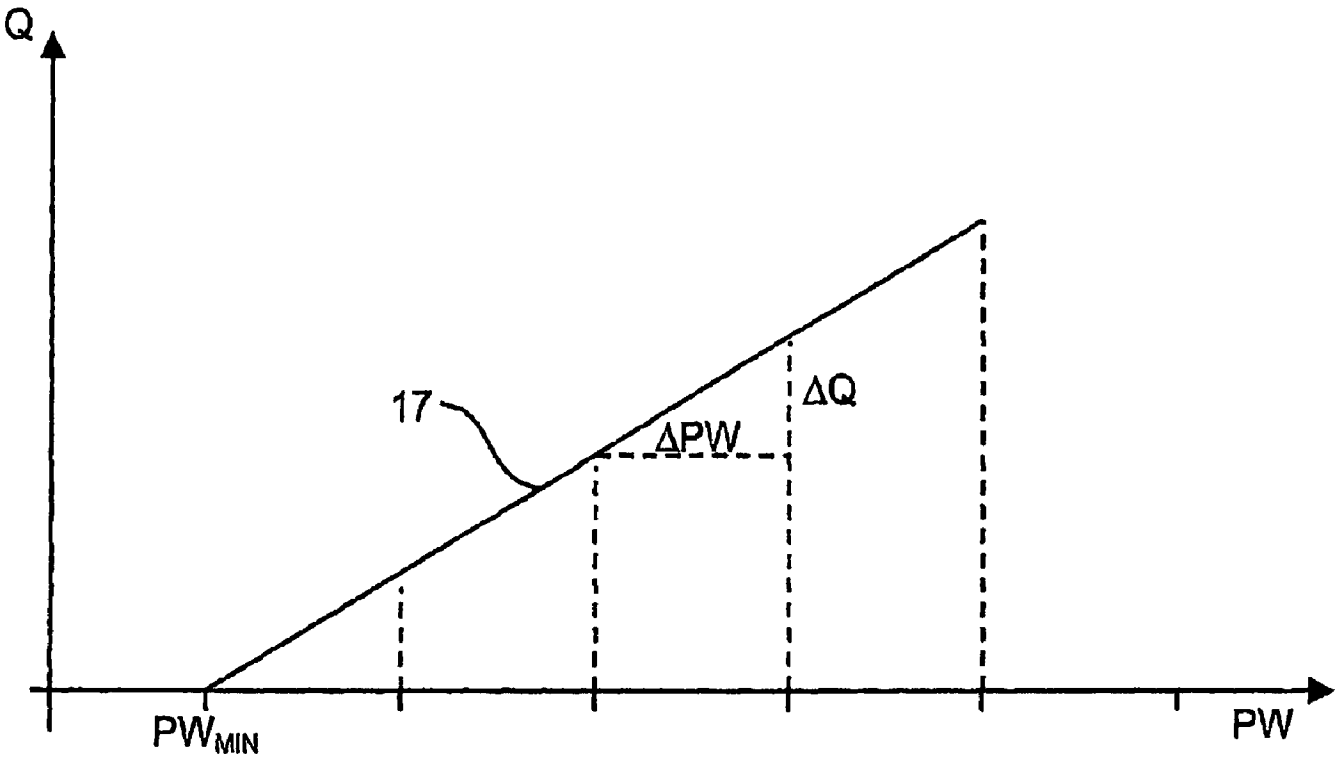

While the activated carbon filter 12 is being flushed, the filling ratio of the internal combustion engine 1 is increased by the fuel vapors flushed from the activated carbon filter 12 which is connected to an increase in performance. However, the control unit 2 compensates for this disturbing influence of regenerating the activated carbon filter 12 by adjusting the throttle valve 7 and changing the ignition angle. In this case, the control unit 2 takes into consideration the air ratio λ measured by the lambda sensor 4 according to a predetermined physical model into which the valve characteristic 17 of the valve 14 stored in a characteristic element is entered, which is shown in FIG. 3 as an example.

In addition, the fuel tank 9 has a pressure sensor 15 which measures the pressure in the fuel tank 9 and is connected to the control unit 2 in order to evaluate the measuring signal.

Finally, another temperature sensor 16 is arranged in the fuel tank 9 which measures the fuel temperature and forwards it to the control unit 2. This advantageously allows a taking into consideration of the temperature of the fuel when determining the quality of the fuel from the emission behavior as a result of which temperature-specific measuring errors are avoided.

Figure 2A:
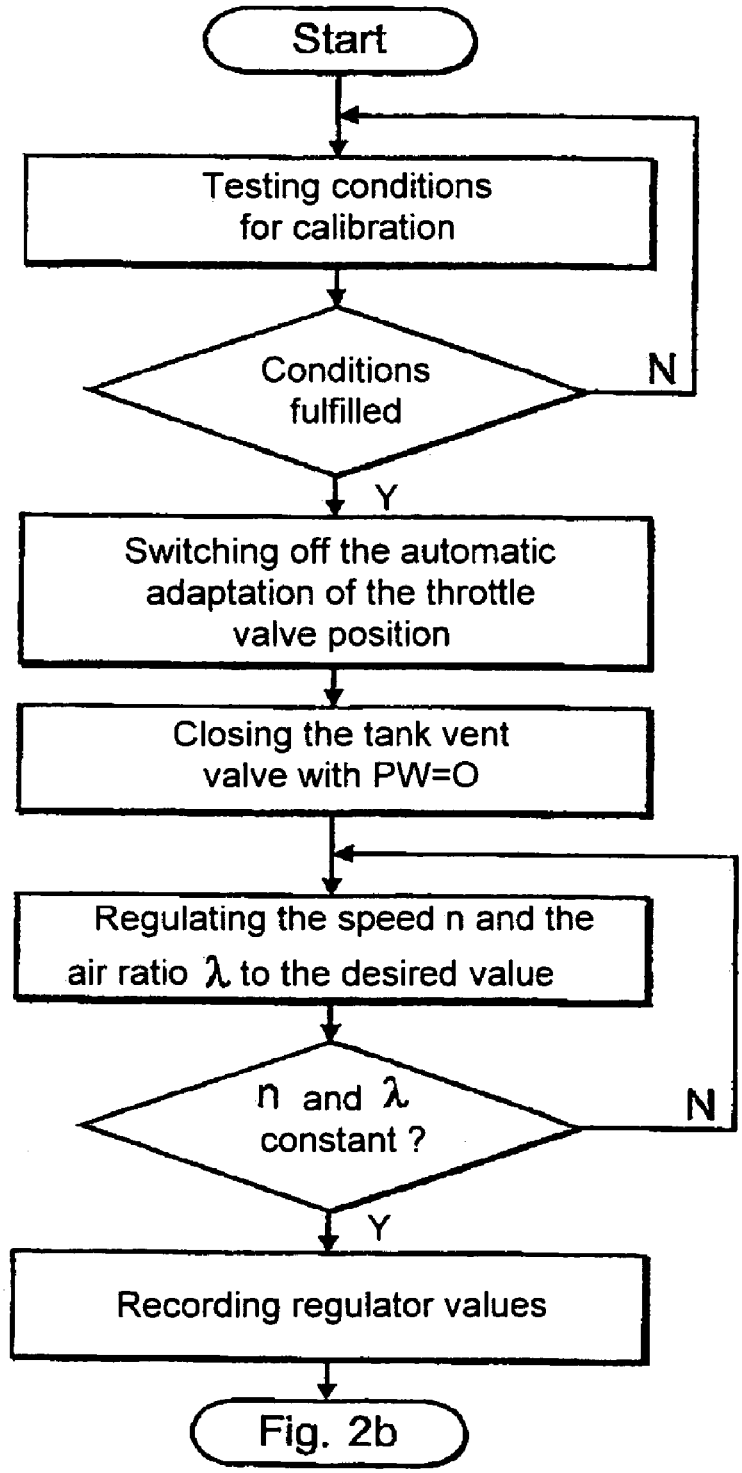
Figure 2B:
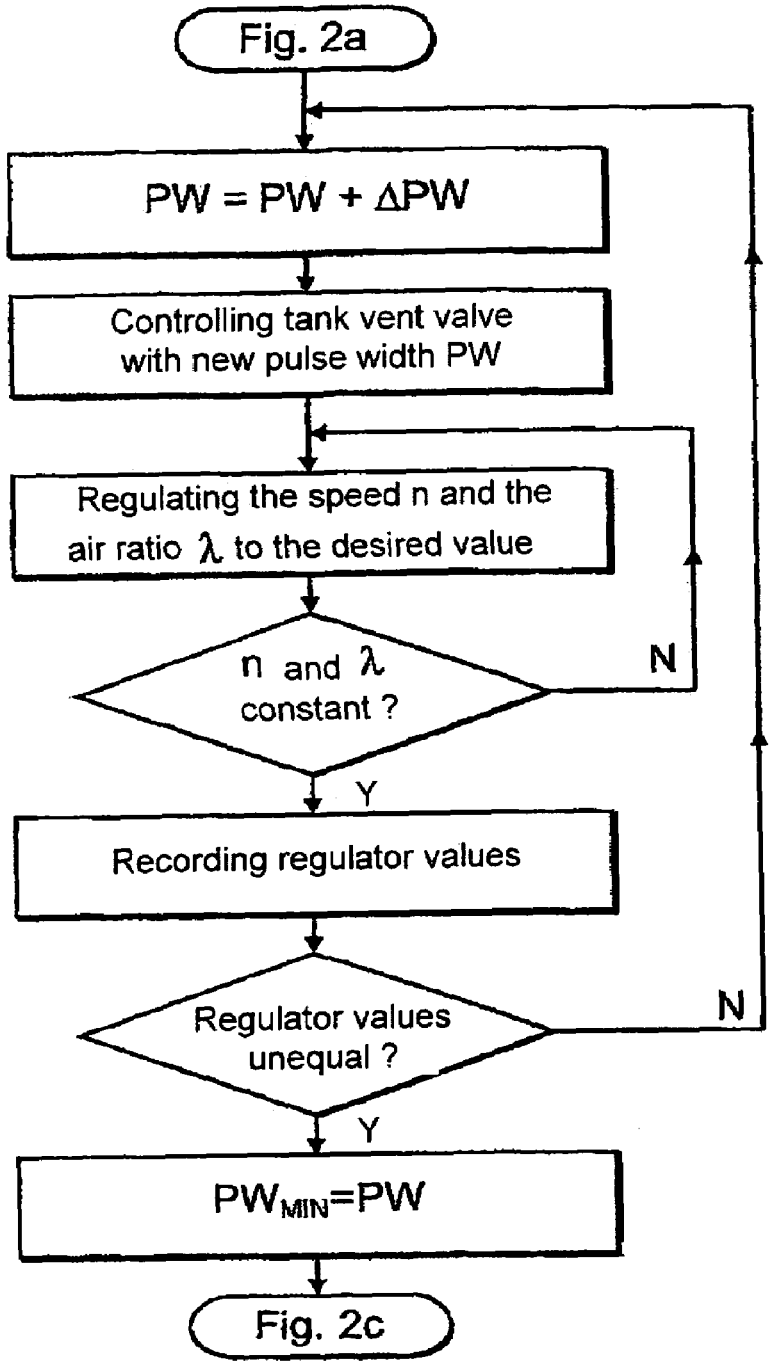
Figure 2C:
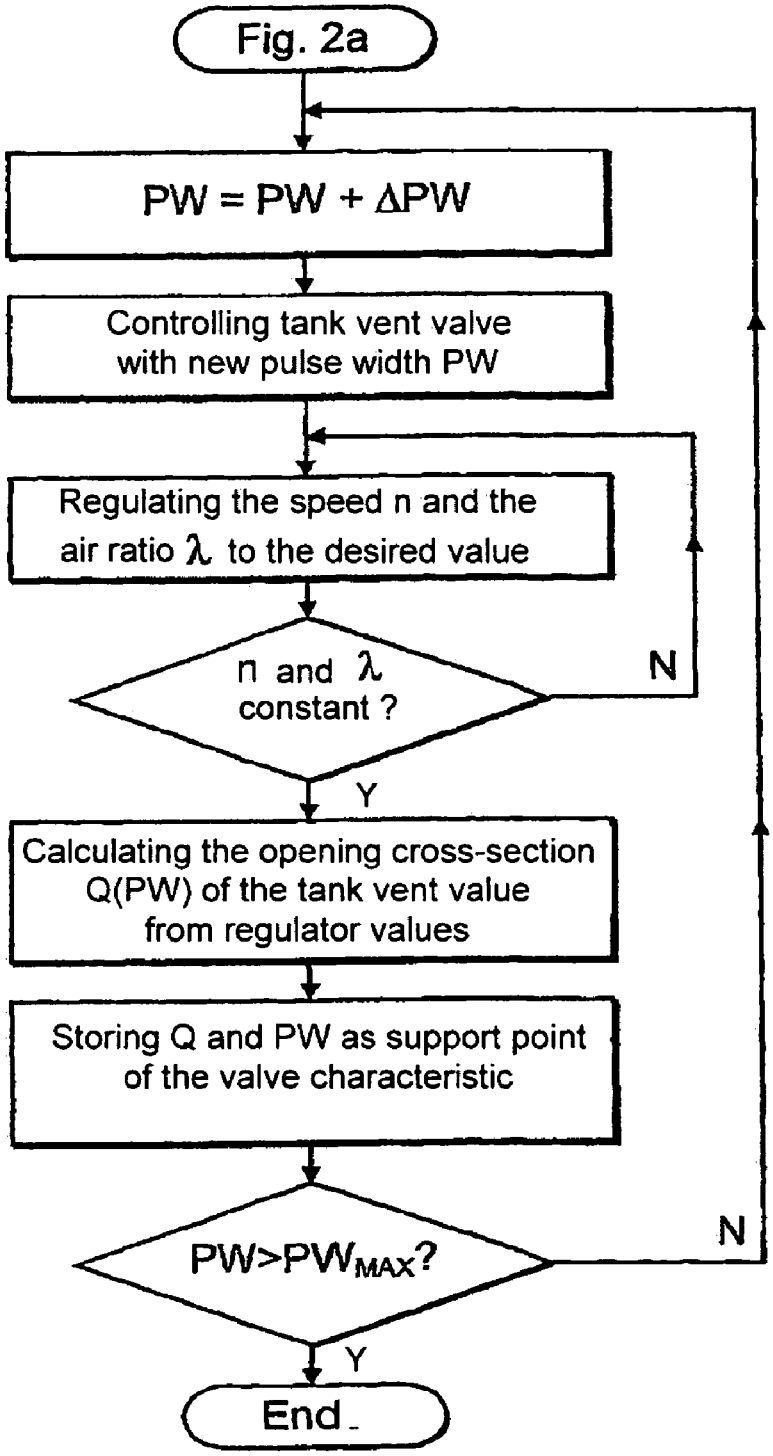

While the internal combustion engine 1 is idling, the control unit 2 carries out a calibration process in order to determine the valve characteristic of valve 14. Accurate knowledge of the valve characteristic of the valve 14 is important so that the control unit 2, while the internal combustion engine 1 is operating normally and while the activated carbon filter 12 is being regenerated in the case of an open valve 14, can subsequently compensate for the disturbing influence of the fuel vapors flushed from the activated carbon filter 12. The course of this calibration process is shown in FIGS. 2*a* to 2*c* in the form of a flow chart and is described below.

At the beginning of the calibration process, a test is first of all carried out to determine whether or not the calibration conditions have been fulfilled. This is then the case if the internal combustion engine 1 is operated while it is idling because then the speed n of the internal combustion engine 1 and the air ratio λ are regulated to predetermined desired values.

If the calibration conditions have been fulfilled, the automatic adaptation of the throttle valve position is switched off in a next step. Otherwise, it is necessary to wait until the calibration conditions have been fulfilled.

The valve 14 is then closed in a next step by controlling the valve 14 with a pulse-width modulated control signal with a pulse width of PW=O.

In addition, the speed n and the air ratio λ can be regulated by the control unit 2 to the predetermined desired values until the desired values have been reached.

The controlled variables such as the ignition angle and the position of the throttle valve 7 are then stored in this stationary idling operating mode. Knowledge of the controlled variables while in the stationary idling operating mode is important in order to be able to derive subsequently the control deviation and the resulting valve position of the valve 14.

In FIG. 2*b*, the pulse width PW is then increased by a predetermined incremental value ΔPW and the valve 14 is controlled with an increased pulse width PW.

The speed n and the air ratio λ are then again controlled until the stationary idling operating mode has been reached.

As a result, the controlled variables which are required for controlling the disturbance are again stored.

If these new controlled variables correspond to the controlled variables determined beforehand while in the stationary idling operating mode, then the filling ratio of the internal combustion engine 1 was still not increased by the fuel vapors from the activated carbon filter 12 so that it can be assumed that the valve 14 is still closed in the case of the pulse width PW.

The pulse width PW is then increased until the new controlled variables deviate significantly from the controlled variables determined at the beginning for the stationary idling operating mode which points to an open valve 14. The current pulse width PW is then equal to the pulse width $PW_{MIN}$ in the case of which the valve 12 opens as is shown on the basis of the valve characteristic 17 in FIG. 3.

In the steps of the calibration method according to the invention shown in FIG. 2*c*, the additional course of the valve characteristic 17 is then still determined.

For this purpose, the pulse width PW is increased progressively by the incremental value ΔPW whereby it is necessary in each case to wait until the speed n and the air ratio λ are regulated to the predetermined desired values.

In this case, the controlled variables that are required to compensate for the fuel vapors extracted or drawn off from the activated carbon filter 12 are determined in each case.

The associated valve position Q is then determined from these controlled variables as a result of which a support point ($Q_1$, $PW_1$) is then known.

Numerous support points of the valve characteristic 17 are then determined consecutively in this way until the pulse width PW exceeds a predetermined maximum value $PW_{MAX}$.

The individual support points of the valve characteristic 17 are then stored in a characteristic element and used while the internal combustion engine 1 is operating normally in order to compensate for the fuel vapors flushed from the activated carbon filter 12 while the activated carbon filter 12 is being regenerated.

The invention is not limited to the preferred embodiment described above. A plurality of variants and deviations that makes use of the idea of the invention and therefore falls within the scope covered by the invention is now possible.

We claim:

1. A method for controlling a regeneration valve of a fuel vapor retention system for an internal combustion engine, comprising:

sequentially controlling the regeneration valve with different values of a control signal;

regulating a speed and/or an air ratio of the internal combustion engine to predetermined desired values for each value of the control signal and determining the engine intervention required;

deriving a valve position of the regeneration valve from the engine intervention for each value of the control signal; and storing the individual values of the control signal and the resulting valve position as support points of a valve characteristic.

2. The method as claimed in claim 1, wherein the regeneration valve of the fuel vapor retention system is a tank vent valve for regenerating an activated carbon filter during which the regeneration valve is controlled by the control signal and the control signal corresponds to a designated valve position of the regeneration valve and the correlation between the control signal and the resulting valve position of the regeneration valve is determined during a calibration process.

3. The method as claimed in claim 2, further comprising;

opening the regeneration valve for regenerating the fuel vapor retention system by controlling with a predetermined control signal;

extracting or drawing off fuel vapor from the fuel vapor retention system in the internal combustion engine compensating for the change in the mixture composition by the extracted or drawn off fuel vapor by means of an engine intervention; and determining the correlation between the control signal and the resulting valve position of the regeneration valve from the predetermined control signal and the engine intervention required for the compensation.

4. The method as claimed in claim 3, wherein the engine intervention to compensate for the change in the mixture composition includes an ignition angle.

5. The method as claimed in claim 3, wherein the engine intervention with a view to compensating for the change in the mixture composition includes changing the throttle valve position.

6. The method as claimed in claim 3, wherein the speed of the internal combustion engine is measured and regulated to a predetermined desired value by engine intervention while the fuel vapor retention system is being regenerated.

7. The method as claimed in claim 3, wherein the air ratio of the exhaust gas of the internal combustion engine is measured and regulated to a predetermined desired value by engine intervention while the fuel vapor retention system is being regenerated.

8. The method as claimed in claim 3, wherein the engine intervention is determined during the calibration process and is compared to a predetermined limiting value to determine the control signal in the case of which the regeneration valve opens.

9. The method as claimed in claim 3, wherein the valve position of the regeneration valve is determined from the engine intervention required for the compensation.

* * * * *